US008056613B2

(12) United States Patent
Frijas

(10) Patent No.: US 8,056,613 B2
(45) Date of Patent: Nov. 15, 2011

(54) VEHICLE INCLUDING HEAT GUARD FOR CONTROL MODULE

(75) Inventor: Rodney Frijas, Columbus, OH (US)

(73) Assignee: Honda Motor Company, Ltd., Tokyo (JP)

( * ) Notice: Subject to any disclaimer, the term of this patent is extended or adjusted under 35 U.S.C. 154(b) by 1145 days.

(21) Appl. No.: 11/731,597

(22) Filed: Mar. 30, 2007

(65) Prior Publication Data

US 2007/0245985 A1 Oct. 25, 2007

Related U.S. Application Data

(60) Provisional application No. 60/788,258, filed on Mar. 31, 2006.

(51) Int. Cl.
*B60H 1/00* (2006.01)
*B60H 1/34* (2006.01)
*B60H 3/00* (2006.01)

(52) U.S. Cl. ..... 165/41; 165/44; 165/51; 165/80.3; 165/134.1; 123/198 E; 180/68.1; 180/68.4; 180/229

(58) Field of Classification Search ..... 165/41, 165/44, 47, 51, 121, 122, 80.3; 180/68.1, 180/68.4, 229; 123/198 E
See application file for complete search history.

(56) References Cited

U.S. PATENT DOCUMENTS

| | | | | |
|---|---|---|---|---|
| 2,551,921 | A | 5/1951 | Arsem | |
| 2,729,202 | A | 1/1956 | Sanders | |
| 4,011,921 | A | 3/1977 | Sakamoto et al. | |
| 4,546,843 | A | 10/1985 | Koinuma et al. | |
| 4,592,437 | A | 6/1986 | Holm et al. | |
| 5,915,344 | A | 6/1999 | Suzuki et al. | |
| 6,102,149 | A | 8/2000 | Suzuki et al. | |
| 6,105,701 | A | 8/2000 | Buell | |
| 6,106,228 | A | 8/2000 | Bartlett | |
| 6,276,482 | B1 | 8/2001 | Moriya et al. | |
| 6,695,088 | B2 | 2/2004 | Schroeder | |
| 6,779,622 | B2 | 8/2004 | Mizorogi | |
| 6,889,911 | B2 | 5/2005 | Uglietto et al. | |
| 7,537,499 | B2 * | 5/2009 | Davis et al. | 280/783 |
| 2005/0039719 | A1 | 2/2005 | Moss | |

FOREIGN PATENT DOCUMENTS

JP 56025021 A * 3/1981

* cited by examiner

*Primary Examiner* — John Ford
(74) *Attorney, Agent, or Firm* — Ulmer & Berne LLP

(57) ABSTRACT

A vehicle, such as a motorcycle or ATV, includes a frame, an internal combustion engine, a radiator, a control module and a heat guard. The radiator is configured for receiving fresh air and for expelling heated air. The control module includes an engine control unit for the internal combustion engine. At least a portion of the heat guard is positioned adjacent to and between the radiator and the control module. The heat guard is configured to deflect at least a portion of the heated air expelled by the radiator from contacting the control module. The heat guard is also configured for receiving fresh air for cooling the heat guard to reduce radiation of heat from the heat guard to the control module.

14 Claims, 4 Drawing Sheets

VEHICLE INCLUDING HEAT GUARD FOR CONTROL MODULE

RELATED APPLICATION

The present application claims priority of U.S. Provisional Application Ser. No. 60/788,258 filed Mar. 31, 2006 and hereby incorporates the same Provisional Application by reference.

TECHNICAL FIELD

The present invention relates to a vehicle having a heat guard positioned between a radiator and a control module on the vehicle. The heat guard is configured to protect the control module from receiving excessive heat from the radiator.

BACKGROUND OF THE INVENTION

Many vehicles include an internal combustion engine and an engine control unit which manages and monitors operation of the internal combustion engine. As the engine control unit typically includes complex and sensitive electronic components, it is often desirable to locate the engine control unit in a position upon the vehicle where it is unlikely to sustain damage from impact, heat, moisture and/or other environmental conditions.

Positioning of an engine control unit can accordingly be challenging in many vehicles, particularly open-type vehicles such as motorcycles and all-terrain vehicles ("ATVs"). In many circumstances, it has been found desirable to locate the engine control unit adjacent to the vehicle's radiator. However, in such circumstances, heat generated by the radiator can adversely affect the engine control unit.

Accordingly, in one conventional arrangement, as shown in FIG. 2, a heat guard 112 is disposed between a radiator 110 and a control module 114 upon a vehicle. The control module 114 is shown to be seated within a support assembly 116. The heat guard 112 is shown to comprise a heat guard panel 126 and an insulation member 118 attached to the heat guard panel 126. Upon movement of the vehicle, fresh air 120 impacts the heat guard 112 and is directed upwardly, and fresh air 122 passes through the radiator 110 and is converted into heated air 124. At least a portion of the heated air 124 impacts the heat guard 112 and is accordingly prevented from impacting the control module 114. However, after prolonged impact of the heated air 124 against the heat guard 112, the temperature of the heat guard 112 can increase substantially, and the heat guard 112 can accordingly radiate heat (e.g., shown as 125) to the control module 114. Accordingly, even though the heat guard 112 can prevent the heated air 124 from directly impacting the control module 114, the heat radiated from the heat guard 112 can result in excessive heating of the control module 114.

SUMMARY OF THE INVENTION

In accordance with one embodiment of the present invention, a vehicle comprises a frame, an internal combustion engine, a radiator, a control module, and a heat guard. Each of the internal combustion engine, the radiator, the control module, and the heat guard are supported with respect to the frame. The radiator is configured for receiving fresh air and for expelling heated air. The control module comprises an engine control unit for the internal combustion engine. At least a portion of the heat guard is positioned between, adjacent to, and spaced from the radiator and the control module.

The heat guard is configured to deflect at least a portion of the heated air expelled by the radiator from contacting the control module. The heat guard comprises a first lip portion configured for receiving fresh air for passage between the heat guard and the radiator to assist in cooling the heat guard.

In accordance with another embodiment of the present invention, an all terrain vehicle comprises a frame, a radiator, a control module, and a heat guard. The radiator and the control module are supported with respect to the frame. The radiator is configured for receiving fresh air and for expelling heated air. The heat guard is supported with respect to the frame in a location adjacent to and between the radiator and the control module. The heat guard has a first surface and a second surface. At least a portion of the first surface faces the radiator and is spaced from the radiator. At least a portion of the second surface faces the control module and is spaced from the control module. The first surface is configured to deflect at least a portion of the heated air expelled by the radiator from contacting the control module. The heat guard is configured to receive fresh air for passage over at least one of the first surface and the second surface for cooling of the heat guard to reduce radiation of heat from the heat guard to the control module.

In accordance with yet another embodiment of the present invention, a motorcycle comprises a frame, a radiator, a control module, and a heat guard. The radiator and the control module are supported with respect to the frame. The radiator is configured for receiving fresh air and for expelling heated air. The heat guard is supported with respect to the frame in a location adjacent to and between the radiator and the control module. The heat guard has a first surface and a second surface. At least a portion of the first surface faces the radiator and is spaced from the radiator. At least a portion of the second surface faces the control module and is spaced from the control module. The first surface is configured to deflect at least a portion of the heated air expelled by the radiator from contacting the control module. The heat guard is configured to receive fresh air for passage over at least one of the first surface and the second surface for cooling of the heat guard to reduce radiation of heat from the heat guard to the control module.

BRIEF DESCRIPTION OF THE DRAWINGS

While the specification concludes with claims particularly pointing out and distinctly claiming the present invention, it is believed that the same will be better understood from the following description taken in conjunction with the accompanying drawings in which:

DETAILED DESCRIPTION OF EMBODIMENTS

The present invention and its operation is hereinafter described in detail in connection with the views and examples of FIGS. 1-5, wherein like numbers indicate the same or corresponding elements throughout the views. A heat guard in accordance with the teachings of the present invention can be provided upon any of a variety of specific vehicles, including, for example, automobiles, trucks, vans, motorcycles, recreational vehicles, watercraft, aircraft, agricultural equipment, construction equipment, toys, or other power equipment. While such vehicles typically include an internal combustion engine, it will be appreciated that a vehicle in accordance with the teachings of the present invention may be alternatively powered (e.g., by an electric motor), but may nevertheless include a radiator such as for use in cooling the alternative power source (e.g., an electric motor and/or an electronic controller therefor).

Figure 1:
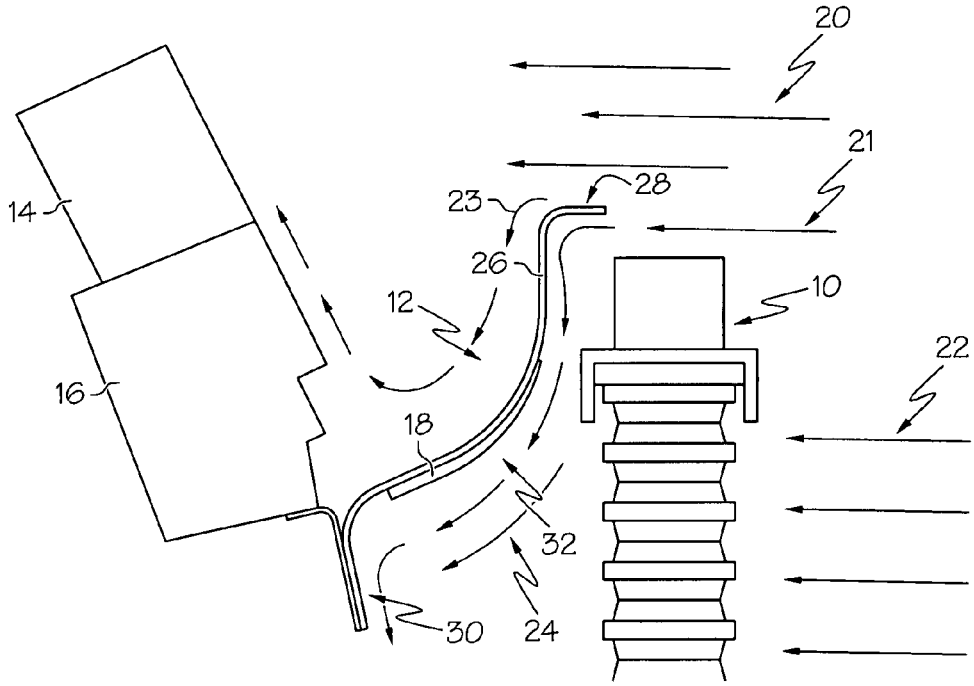
FIG. 1 is a side elevational view depicting a heat guard in association with a radiator and a control module in accordance with one embodiment of the present invention.
Figure 2:
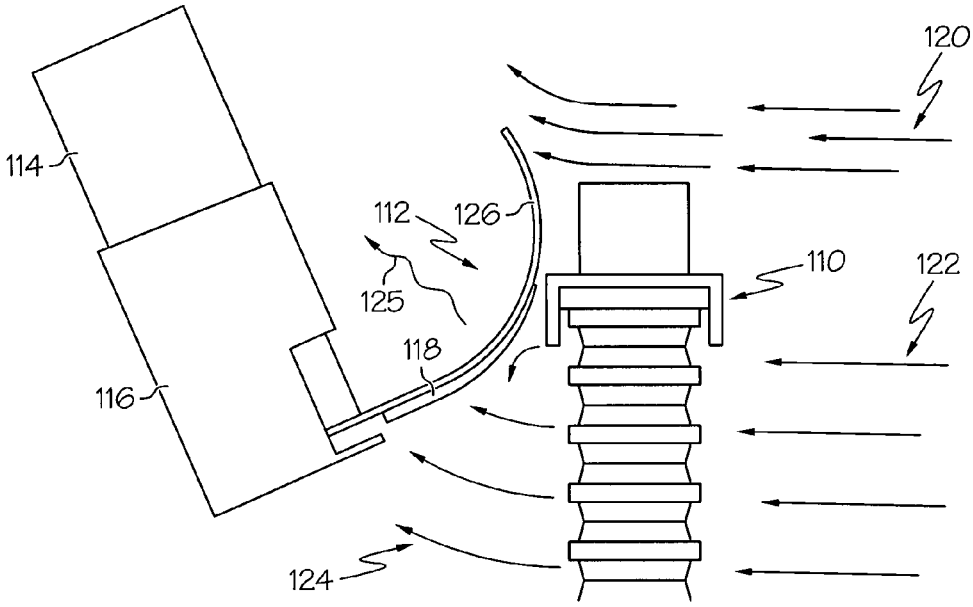
FIG. 2 (PRIOR ART)
FIG. 2 is a side elevational view depicting a conventional heat guard in association with a radiator and a control module.

Referring to FIG. 1, a heat guard 12 is depicted in association with a radiator 10 and a control module 14 as those components might be provided upon a vehicle in accordance with one embodiment of the present invention. The radiator 10 can be configured for cooling of an internal combustion engine present upon the vehicle such as by receiving heated engine oil and/or engine coolant. In other embodiments, the radiator 10 could be configured for receiving transmission fluid, hydraulic fluid, power steering fluid, transfer case fluid, differential fluid, refrigerant, and/or any of a variety of other fluids present upon the vehicle for which cooling may be necessary or advantageous.

The control module 14 is supported with respect to the frame of a vehicle. In the embodiment of FIG. 1, the control module 14 is shown to be housed within a support assembly 16, and the support assembly 16 can supported with respect to a vehicle's frame. It will be appreciated that support of a component with respect to a vehicle's frame can involve a direct or indirect attachment of that component to the vehicle's frame, and that this applies not only to support of a control module, but to any other vehicle component as well.

In one embodiment of the present invention, the control module 14 can comprise an engine control unit for an internal combustion engine present upon the vehicle. In other embodiments, however, the control module 14 could alternatively comprise one or more other electronic or mechanical controls present upon the vehicle. For example, the control module 14 could comprise telecommunications components, global positioning equipment, a security alarm controller, radio components, emission control components, and/or any of a host of other components or devices which are desirably present upon a vehicle. As the control module 14 can include sensitive electronic and/or mechanical components, it can be beneficial to prevent excessive heat from the radiator 10 from impacting, and thus heating, the control module 14.

The heat guard 12 can be located between the radiator 10 and the control module 14 so as to block at least some heat emitted by the radiator 10 from directly contacting the control module 14. The heat guard 12 can accordingly be placed adjacent to each of the radiator 10 and the control module 14, although at least a portion of the heat guard 12 can be spaced from the radiator 10 and/or the control module 14 so that air can flow freely between the heat guard 12 and the radiator 10 and/or the control module 14. Each of the radiator 10, the heat guard 12, and the control module 14 can be supported with respect to a vehicle's frame, as depicted in further detail in the examples of FIGS. 4-5.

Figure 3:
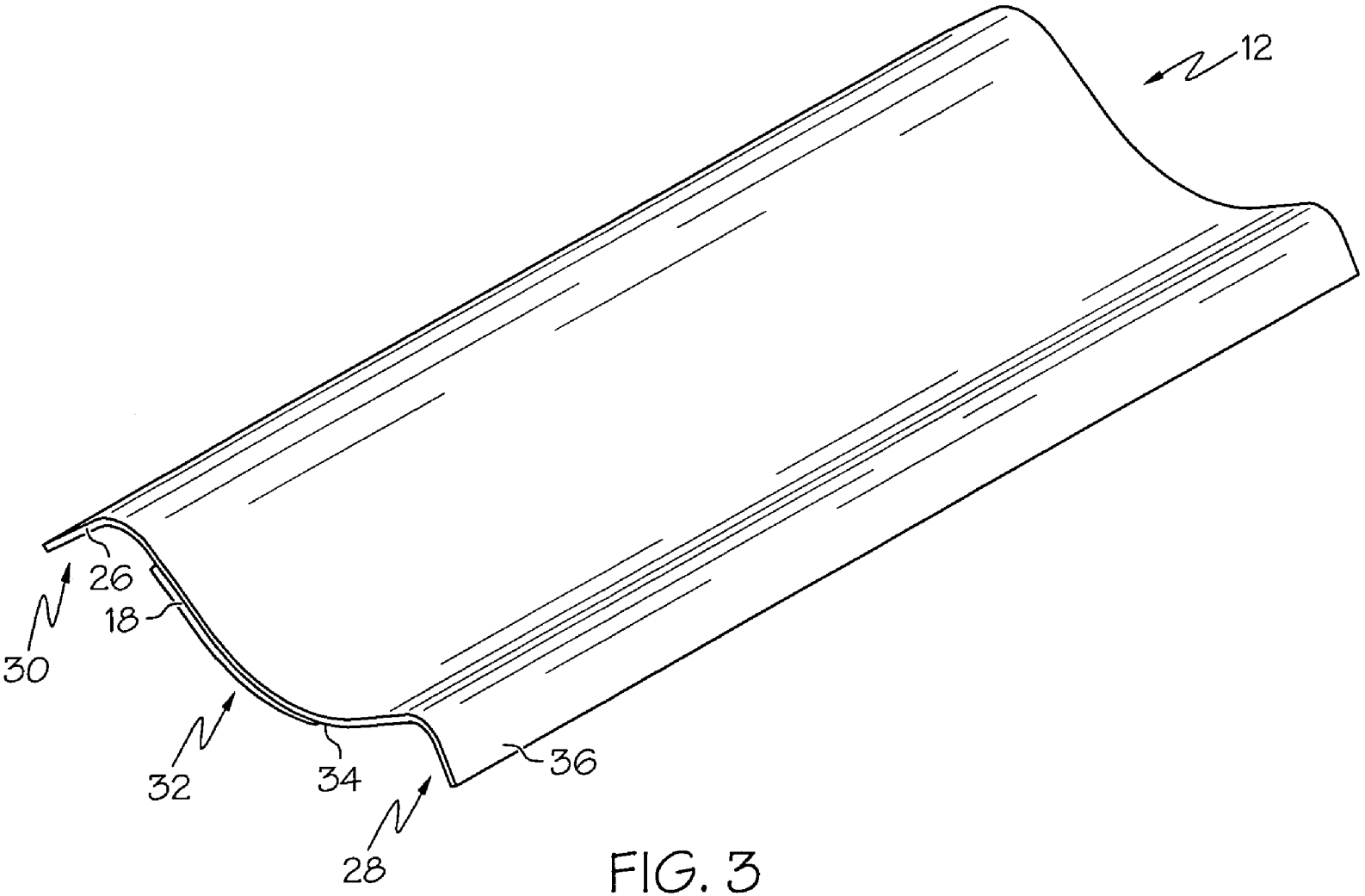
FIG. 3 is a perspective view depicting the heat guard of FIG. 1.

Referring to FIGS. 1 and 3, the heat guard 12 can include a heat guard panel 26. In one embodiment of the present invention, the heat guard panel 26 is formed from metal such as steel or aluminum. However, the heat guard panel 26 can alternatively be formed from molded or rigid plastic, a composite, and/or any of a variety of other materials. Although the heat guard panel 26 is shown in FIGS. 1 and 3 as being formed from a single piece of material, it will be appreciated that multiple pieces of material may alternatively be joined together (e.g., with fasteners, adhesives, and/or welding) to form a heat guard panel in accordance with the teachings of the present invention.

One or more coverings may be applied to the heat guard panel 26 to improve performance and/or appearance of the heat guard 12. For example, an insulation member 18 can be attached to the heat guard panel 26 as shown, for example, in FIGS. 1 and 3. The insulation member 18 can comprise foam, fiberglass, and/or any of a variety of other materials. The insulation member 18 can serve to help prevent the heat guard panel 26 from being heated by the heated air 24 from the radiator 10, and can therefore assist in preventing excessive radiation of heat from the heat guard 12 to the control module 14. While the insulation member 18 is shown only to cover a portion of one side of the heat guard panel 26, it will be appreciated that the insulation member 18 could alternatively cover part or all of one or both sides of the heat guard panel 26. Other possible coverings for the heat guard panel 26 can include, for example, paint, fabric, and electroplated finishes.

The heat guard 12 is shown in FIG. 3 to have a first surface 34 and a second surface 36. While the entirety of both the first surface 34 and the second surface 36 can be provided by the heat guard panel 26, one or more portions of the first surface 34 and/or the second surface 36 can alternatively be provided by multiple heat guard panels or components and/or by coverings for one or more heat guard panels of a heat guard 12 in accordance with the teachings of the present invention. For example, as shown in FIGS. 1 and 3, the entire second surface 36 of the heat guard 12 is shown to be provided by the heat guard panel 26, while respective portions of the first surface 34 of the heat guard 12 are provided by the heat guard panel 26 and the insulation member 18. The heat guard 12 can be located such that at least a portion of the first surface 34 faces the radiator 10 and is spaced from the radiator 10, and at least a portion of the second surface 36 faces the control module 14 and is spaced from the control module 14. The first surface 34 can be configured to deflect at least a portion of the heated air 24 expelled by the radiator 10 from contacting the control module 14. The heat guard 12 can additionally be configured to receive fresh air (e.g., 21, 23) for passage over at least one of the first surface 34 and the second surface 36 for cooling of the heat guard 12 to reduce radiation of heat from the heat guard 12 to the control module 14.

In one embodiment, the heat guard 12 can include a first lip portion 28, a second lip portion 30, and a ducting portion 32 as shown, for example, in FIGS. 1 and 3. The first lip portion 28 and the second lip portion 30 can each be configured to extend away from the control module 14 as shown, for example, in FIG. 1. The ducting portion 32 can be curved and can connect the first lip portion 28 with the second lip portion 30. The first lip portion 28 can be configured for receiving and/or directing fresh air for passage over the first surface 34 and/or the second surface 36 of the heat guard 12. The second lip portion 30 can be configured for expelling air away from the radiator 10 and the control module 14 as shown, for example, in FIG. 1.

Upon movement of a vehicle having the components of FIG. 1, fresh air (e.g., 20, 21, 22, and 23) can be forced in the general direction of the radiator 10, the heat guard 12 and the control module 14. The fresh air may or may not be assisted by a fan or blower. A portion of the fresh air (e.g., 22) is shown to be directed for passage through the radiator 10, and then to exit the radiator 10 as heated air 24. At least a portion of the heated air 24 can contact the heat guard 12. The ducting portion 32 and the second lip portion 30 of the heat guard 12 can direct this portion of the heated air 24 downwardly and away from the radiator 10 and the control module 14.

Another portion of the fresh air (e.g., 21) can be captured by the first lip portion 28 of the heat guard 12 and can be directed downwardly over the first surface 34 of the heat guard 12 and between the radiator 10 and the control module 14. This fresh air then passes over the ducting portion 32 and the second lip portion 30 of the heat guard 12 which direct this air downwardly and away from the radiator 10 and the control module 14. By passing over the heat guard 12 in this manner, the fresh air (e.g., 21) provides cooling for the heat guard 12 which thereby prevents excessive heating of the heat guard 12 arising from prolonged incidence with the heated air 24 from the radiator 10.

The control module 14 can also be configured for receiving fresh air as shown, for example, in FIG. 1. In particular, a portion of the fresh air (e.g., 20) is shown to be directed for contacting the control module 14 which can accordingly result in cooling of the control module 14. This same portion of fresh air (e.g., 20) and/or another portion of fresh air (e.g., 23) can flow over the second surface 36 of the heat guard 12 (with or without being so directed by the heat guard 12 itself) in order to facilitate further cooling of the heat guard 12 and/or resultant sweeping away of radiated heat.

Figure 4:
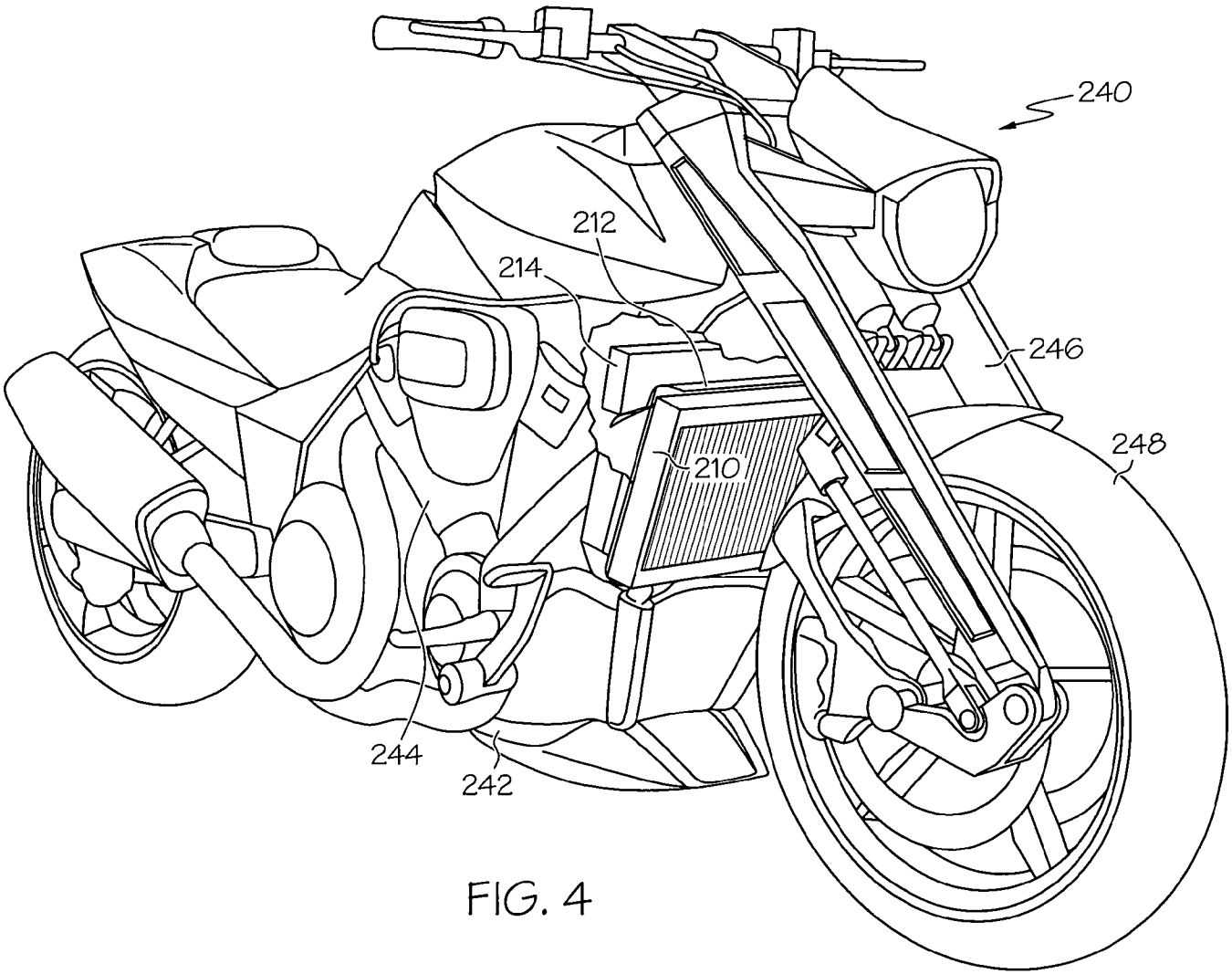
FIG. 4 is a perspective view depicting a motorcycle including a heat guard in accordance with another embodiment of the present invention.

FIG. 4 depicts a motorcycle 240 having a heat guard 212 in accordance with another embodiment of the present invention. The motorcycle 240 includes a frame 242 and an internal combustion engine 244 supported with respect to the frame 242. The motorcycle 240 also includes a radiator 210 and a control module 214, both of which are also supported with respect to the frame 242. The motorcycle 240 additionally includes a fork 246 and a front wheel 248 which are both positioned ahead of the radiator 210. The heat guard 212 is shown to be supported with respect to the frame 242 in a position between and adjacent to each of the radiator 210 and the control module 214. The heat guard 212 can be configured similarly and/or can function similarly to the heat guard 12 discussed above with reference to FIGS. 1 and 3.

Figure 5:
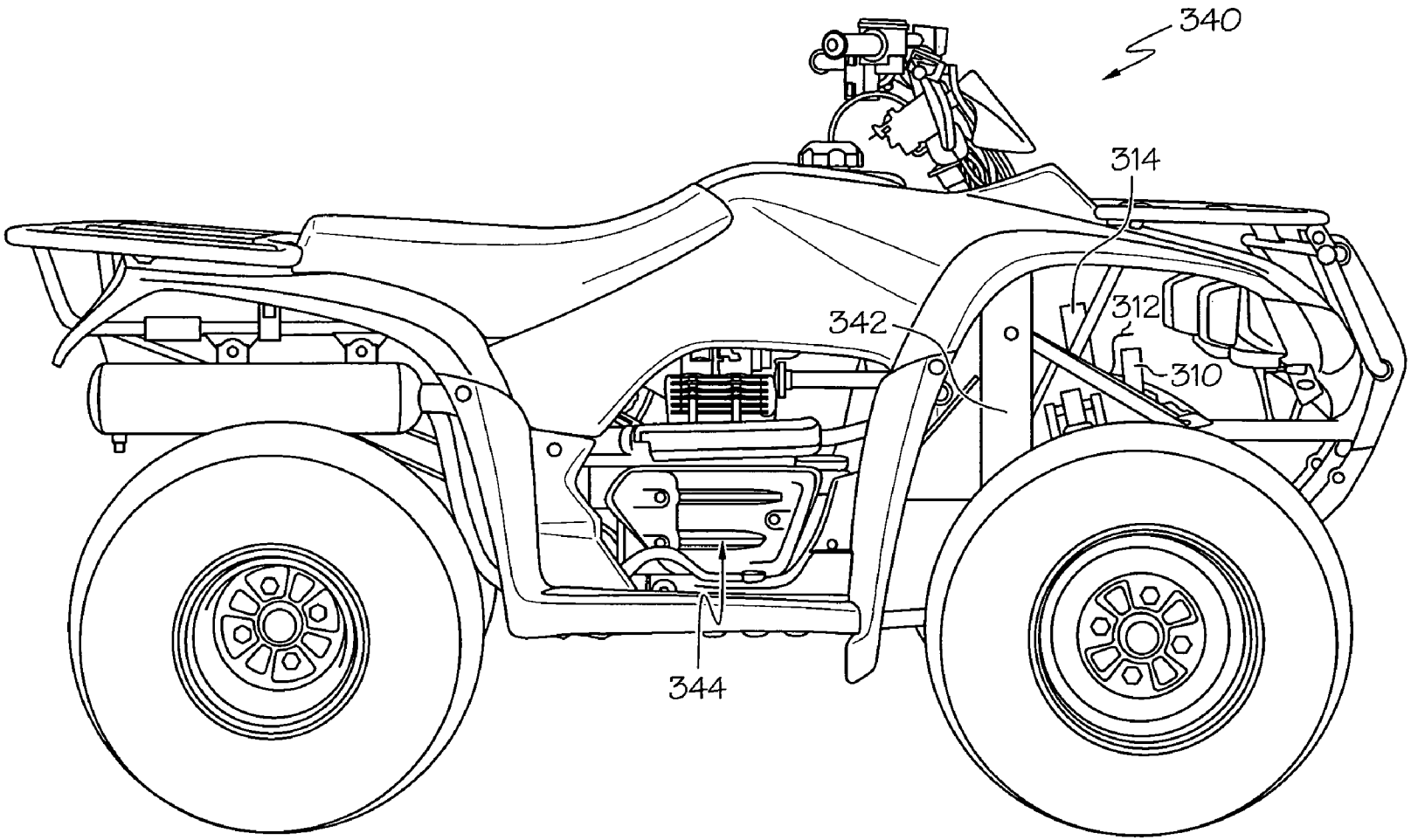
FIG. 5 is a perspective view depicting an ATV including a heat guard in accordance with yet another embodiment of the present invention.

FIG. 5 depicts an ATV 340 having a heat guard 312 in accordance with yet another embodiment of the present invention. The ATV 340 includes an internal combustion engine 344, a radiator 310, the heat guard 312, and a control module 314, all of which are shown to be supported with respect to a frame 342. The heat guard 312 is shown to be disposed adjacent to and between each of the radiator 310 and the control module 314. The heat guard 312 can be configured similarly and/or can function similarly to the heat guard 12 discussed above with reference to FIGS. 1 and 3. While a heat guard in accordance with the teachings of the present invention can be provided upon any of a variety of vehicles as described above, it will be appreciated that a heat guard in accordance with the teachings of the present invention provides particular advantages when used upon an open-type vehicle such as a motorcycle or ATV, as suitable mounting locations for control modules (e.g., engine control units) are sparse upon such vehicles, and placement of a control module directly behind a radiator is often the only suitable mounting location upon such vehicles for a control module.

The foregoing description of embodiments and examples of the invention has been presented for purposes of illustration and description. It is not intended to be exhaustive or to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A vehicle comprising:

a frame;

an internal combustion engine supported with respect to the frame;

a radiator supported with respect to the frame, the radiator being operable for receiving fresh air and for expelling heated air;

a support assembly;

a control module comprising electronic components, the control module being supported with respect to the frame by the support assembly; and a heat guard supported with respect to the frame, at least a portion of the heat guard positioned between, adjacent to, and spaced from the radiator and the control module such that the heat guard operably deflects at least a portion of the heated air expelled by the radiator from contacting the control module; wherein the heat guard comprises a first surface, a second surface, a first lip portion, a second lip portion and a ducting portion;

at least a portion of the first surface has a convex shape, faces the radiator and is spaced from the radiator;

at least a portion of the second surface has a concave shape, faces the control module and is spaced from the control module; and the first lip portion extends forwardly and away from the control module, the ducting portion is curved and connects the first lip portion with the second lip portion, and the second lip portion extends downwardly and away from the support assembly and the control module, such that the first lip portion operably receives fresh air for passage between the heat guard and the radiator to assist in cooling the heat guard, and the ducting portion and the second lip portion operably cooperate to direct air downwardly and away from the radiator and the control module.

2. The vehicle of claim 1 comprising a saddle-type vehicle.

3. The vehicle of claim 2 comprising a motorcycle.

4. The vehicle of claim 2 comprising an all terrain vehicle.

5. The vehicle of claim 1 wherein the control module comprises an engine control unit for the internal combustion engine.

6. The vehicle of claim 1 wherein the first lip portion defines a first end of the heat guard and the second lip portion defines a second end of the heat guard.

7. The vehicle of claim 6 wherein the second lip portion of the heat guard is located adjacent to the support assembly.

8. A vehicle comprising:

a frame;

a radiator supported with respect to the frame;

a support assembly;

a control module comprising electronic components, the control module being supported with respect to the frame by the support assembly; and a heat guard supported with respect to the frame, at least a portion of the heat guard being disposed in a location adjacent to and between the radiator and the control module, the heat guard comprising a first surface and a second surface; wherein at least a portion of the first surface has a convex shape, faces the radiator and is spaced from the radiator;

at least a portion of the second surface has a concave shape, faces the control module and is spaced from the control module;

the heat guard further comprises a first lip portion, a second lip portion and a ducting portion; and the first lip portion extends forwardly and away from the control module, the ducting portion is curved and connects the first lip portion with the second lip portion, and the second lip portion extends downwardly and away from the support assembly and the control module, such that the first lip portion operably receives fresh air for passage over at least one of the first surface and the second surface for cooling of the heat guard to reduce radiation of heat from the heat guard to the control module, and the ducting portion and the second lip portion operably cooperate to direct air downwardly and away from the radiator and the control module.

9. The vehicle of claim 8 comprising a saddle-type vehicle.

10. The vehicle of claim 9 comprising a motorcycle.

11. The vehicle of claim 9 comprising an all terrain vehicle.

12. The vehicle of claim 8 further comprising an internal combustion engine supported with respect to the frame, wherein the control module comprises an engine control unit for the internal combustion engine.

13. The vehicle of claim 8 wherein the first lip portion defines a first end of the heat guard and the second lip portion defines a second end of the heat guard.

14. The vehicle of claim 13 wherein the second lip portion of the heat guard is located adjacent to the support assembly.

* * * * *